US009372420B2

(12) United States Patent
Mizo et al.

(10) Patent No.: US 9,372,420 B2
(45) Date of Patent: Jun. 21, 2016

(54) HEAT TREATING APPARATUS FOR POWDER PARTICLES AND METHOD OF PRODUCING TONER

(75) Inventors: Yuichi Mizo, Toride (JP); Hironori Minagawa, Moriya (JP); Takakuni Kobori, Toride (JP); Kohji Takenaka, Toride (JP); Takeshi Ohtsu, Toride (JP); Junichi Hagiwara, Tsuchiura (JP); Daisuke Ito, Tsuchiura (JP); Kunihiko Kawakita, Iga (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 147 days.

(21) Appl. No.: 14/123,960

(22) PCT Filed: Jun. 11, 2012

(86) PCT No.: PCT/JP2012/065441

§ 371 (c)(1),
(2), (4) Date: Dec. 4, 2013

(87) PCT Pub. No.: WO2012/173264

PCT Pub. Date: Dec. 20, 2012

(65) Prior Publication Data

US 2014/0120468 A1 May 1, 2014

(30) Foreign Application Priority Data

Jun. 13, 2011 (JP) ..... 2011-131145

(51) Int. Cl.
*G03G 9/08* (2006.01)
*F26B 17/10* (2006.01)

(52) U.S. Cl.
CPC ..... *G03G 9/0802* (2013.01); *F26B 17/103* (2013.01); *G03G 9/081* (2013.01); *G03G 9/0804* (2013.01); *G03G 9/0806* (2013.01); *G03G 9/0808* (2013.01); *G03G 9/0815* (2013.01)

(58) Field of Classification Search
CPC ... G03G 9/081; G03G 9/0815; G03G 9/0827; G03G 9/0817; F26B 17/103
USPC ..... 430/137.1, 137.18, 137.2
See application file for complete search history.

(56) References Cited

U.S. PATENT DOCUMENTS 6,270,937 B2 8/2001 Yuasa et al.
8,148,040 B2 4/2012 Yamamoto et al.

(Continued)

FOREIGN PATENT DOCUMENTS

CN 1514310 A 7/2004
CN 1664708 A 9/2005

(Continued)

OTHER PUBLICATIONS

Japanese Patent Office machine-assisted English-language translation of JP 2009-020386 A (pub. Jan. 2009).*

(Continued)

*Primary Examiner* — Janis L Dote
(74) *Attorney, Agent, or Firm* — Fitzpatrick, Cella, Harper and Scinto

(57) ABSTRACT

A heat treating apparatus for powder particles containing a binder resin and a colorant, the heat treating apparatus including: a treating chamber in which a heat treatment of the powder particles is performed; a raw material-supplying unit for supplying the powder particles to the treating chamber; a hot air-supplying unit that supplies hot air to the treating chamber; a cold air-supplying unit that supplies cold air for cooling the heat-treated powder particles; and a recovering unit that recovers the heat-treated powder particles. The raw material-supplying unit includes an introducing tube and a distributing member, and the distributing member is provided with a protruding member on a portion opposite to an outlet portion of the introducing tube, and the distributing member includes a supplying tube including two or more flow paths that extend radially outwardly from the protruding member to a wall surface of the treating chamber.

5 Claims, 6 Drawing Sheets

(56) References Cited

U.S. PATENT DOCUMENTS

| | | | |
|---|---|---|---|
| 8,455,167 | B2 | 6/2013 | Shiotari et al. |
| 2005/0074608 | A1 | 4/2005 | Sawada et al. |
| 2009/0197190 | A1 | 8/2009 | Nakamura et al. |
| 2010/0119968 | A1 | 5/2010 | Komatsu et al. |
| 2013/0323638 | A1 | 12/2013 | Minagawa et al. |
| 2014/0096409 | A1 | 4/2014 | Ohtsu et al. |
| 2014/0101966 | A1 | 4/2014 | Minagawa et al. |
| 2014/0137428 | A1 | 5/2014 | Takenaka et al. |

FOREIGN PATENT DOCUMENTS

| | | | | |
|---|---|---|---|---|
| CN | 101334596 | A | | 12/2008 |
| CN | 101498904 | A | | 8/2009 |
| JP | 59-125745 | A | | 7/1984 |
| JP | 59-127662 | A | | 7/1984 |
| JP | 59-158733 | A | | 9/1984 |
| JP | 62-132534 | A | | 6/1987 |
| JP | 4-126534 | A | | 4/1992 |
| JP | 5-11496 | A | | 1/1993 |
| JP | 7-271090 | A | | 10/1995 |
| JP | 11-295929 | A | | 10/1999 |
| JP | 2000-29241 | A | | 1/2000 |
| JP | 2000-140661 | A | | 5/2000 |
| JP | 2004-189845 | A | | 7/2004 |
| JP | 2004-276016 | A | | 10/2004 |
| JP | 2009-020386 | A | * | 1/2009 |
| JP | 2011-128487 | A | | 6/2011 |
| JP | 2011-128488 | A | | 6/2011 |
| WO | 2011/074060 | A1 | | 6/2011 |
| WO | WO-2012/173165 | A1 | * | 12/2012 |

OTHER PUBLICATIONS

PCT International Search Report and Written Opinion of the International Searching Authority, International Application No. PCT/JP2012/065441, Mailing Date Aug. 7, 2012.

Korean Office Action dated Jul. 24, 2015 in Korean Application No. 10-2014-7000183.

Chinese Office Action dated Nov. 12, 2015 in Chinese Application No. 201280029179.2.

* cited by examiner

HEAT TREATING APPARATUS FOR POWDER PARTICLES AND METHOD OF PRODUCING TONER

TECHNICAL FIELD

The present invention relates to a heat treating apparatus for powder particles for obtaining a toner for use in an image forming method such as an electrophotographic method, an electrostatic recording method, an electrostatic printing method, or a toner jet recording method; and a method of producing a toner by using the heat treating apparatus.

BACKGROUND ART

In recent years, as image quality and precision in copiers and printers have been higher, requirements for the performance of a toner as a developer have been also even severer, and thus a toner having a smaller particle diameter and a sharper particle size distribution with containing no coarse particles and with few fine particles has been being demanded.

Further, as a transferring material for copiers and printers, there has been a need for responding to a variety of materials other than common paper, and the toner has been required to exhibit improved transferring properties. Thus, there have been needs for modifying the surface shape of a toner and further spheroidizing the toner particles.

A method for performing spheroidization and surface modification of a toner includes a method of dispersing and spraying toner particles in hot air by compressed air to perform surface modification and spheroidization (see, Patent Literature 1) and a method of adding an additive such as silica to toner particles and then subjecting the mixture to a heat treatment and fixing the mixture to thereby removing a free additive (see, Patent Literature 2).

However, if excessive heat is applied to a toner in a method of utilizing heat, toner particles coalesce to each other to cause coarse particles.

A spheroidization treatment apparatus has been also proposed in which a colliding member is provided apart from a lower end outlet of a raw material jet port when thermoplastic particles are spheroidized through contact with hot air (see, Patent Literature 3). However, if members in the apparatus receive heat to accumulate heat, a toner is fused to the members which accumulate heat, thereby not enabling stable production. Thus, the apparatus is not preferable in production of a toner.

In order to resolve the above troubles, a spheroidization treatment apparatus has been also proposed which has a configuration in which a raw material-supplying part is provided in the center of the apparatus and a hot air-supplying part is provided outside of the part (see, Patent Literature 4). However, since such a configuration requires providing a plurality of raw material jet nozzles, grows in size in terms of an apparatus configuration and requires compressed gas for supplying a raw material in a more amount, the configuration is not preferable in terms of production energy. In addition, since raw materials are linearly jetted to annular hot air to thereby generate a loss in a treating portion, the configuration is not efficient in increasing an amount to be treated.

In order to improve cleaning properties of a toner, as an apparatus that prevents particles having an extremely high circularity from being generated and enables a uniform and stable heat treatment, a method of providing a plurality of supplying parts to supply powder particles from the outside of hot air has also been studied. However, since the plurality of supplying parts to be usually considered (see, FIG. 9) cause an increase in number of supplying apparatuses by the number of the supplying parts, problems are an increase in space efficiency (occupied area by an apparatus for ensuring a desired amount of production) as well as a decrease in energy efficiency and maintenance load. Further, in the case where variation in amounts to be supplied from the plurality of supplying parts is generated, there is a problem such as an increase in coalesced particles in treating.

In addition, a branching method described in Patent Literature 5 causes a difference in flow speed in a pipe in the case of having no choice but to bend the pipe from the restrictions of layout, and the method has difficulty in uniformity of distribution. In this way, there is room for improvement in a heat treating apparatus in order to efficiently and stably create a toner having a sharp particle size distribution and a low abundance ratio of particles having an extremely high circularity.

CITATION LIST

Patent Literature

PTL 1: Japanese Patent Application Laid-Open No. H11-295929

PTL 2: Japanese Patent Application Laid-Open No. H07-271090

PTL 3: Japanese Patent Application Laid-Open No. 2004-276016

PTL 4: Japanese Patent Application Laid-Open No. 2004-189845

PTL 5: Japanese Patent Application Laid-Open No. 559-158733

SUMMARY OF INVENTION

Technical Problem

An object of the present invention is to provide a heat treating apparatus for powder particles, that can heat-treat powder particles in a nearly uniform state and can prevent coalesced particles and particles having an extremely high circularity from being generated, even if a throughput or an amount to be treated is increased.

Solution to Problem

The present invention relates to a heat treating apparatus for powder particles each of which contains a binder resin and a colorant, the heat treating apparatus including: (1) a treating chamber in which a heat treatment of the powder particles is performed, (2) a raw material-supplying unit for supplying the powder particles to the treating chamber, (3) a hot air-supplying unit that supplies hot air for heat-treating the powder particles to the treating chamber, (4) a cold air-supplying unit that supplies cold air for cooling the heat-treated powder particles, and (5) a recovering unit that recovers the heat-treated powder particles, wherein the raw material-supplying unit comprises an introducing tube and a distributing member provided opposite to an outlet portion of the introducing tube, and the distributing member is provided with a protruding member on a portion opposite to the outlet portion of the introducing tube, and the distributing member comprises two or more flow paths, the flow paths guiding a raw material in a direction from the protruding member toward a wall surface of the treating chamber.

The present invention also relates to a method of producing a toner with the above configuration used as the heat treating apparatus.

Advantageous Effects of Invention

According to the present invention, powder particles can be heat-treated in a nearly uniform state, and coalesced particles and particles having an extremely high circularity can be prevented from being generated, even if a throughput or an amount to be treated is increased.

Further, according to the present invention, the number of supplying units can be minimized and in particular space efficiency on an unit layout can be enhanced.

Further features of the present invention will become apparent from the following description of exemplary embodiments with reference to the attached drawings.

DESCRIPTION OF EMBODIMENTS

Preferred embodiments of the present invention will now be described in detail in accordance with the accompanying drawings.

In order to respond to an enhancement in transferring properties of a toner recently required, the toner may preferably have an average circularity of 0.960 or more, and more preferably 0.965 or more. On the other hand, it is also revealed that in a circularity distribution, if a frequency of particles having a circularity of 0.990 or more is increased too much, cleaning failure easily occurs.

This is because, in a cleaning method of removing a residual toner from a photosensitive member by using a cleaning member such as a blade, nearly spherical particles easily go through the cleaning blade. In order to prevent the particles from going through the blade, a measure of increasing a contact pressure of the cleaning blade with the photosensitive member can also be taken, but there are limitations because of adverse effects such as a rise in rotating torque of a drum of the photosensitive member and abrasion of the cleaning blade. In order to enhance cleaning properties of a toner, a content of particles having a circularity of 0.990 or more in a toner can be decreased.

Figure 1:
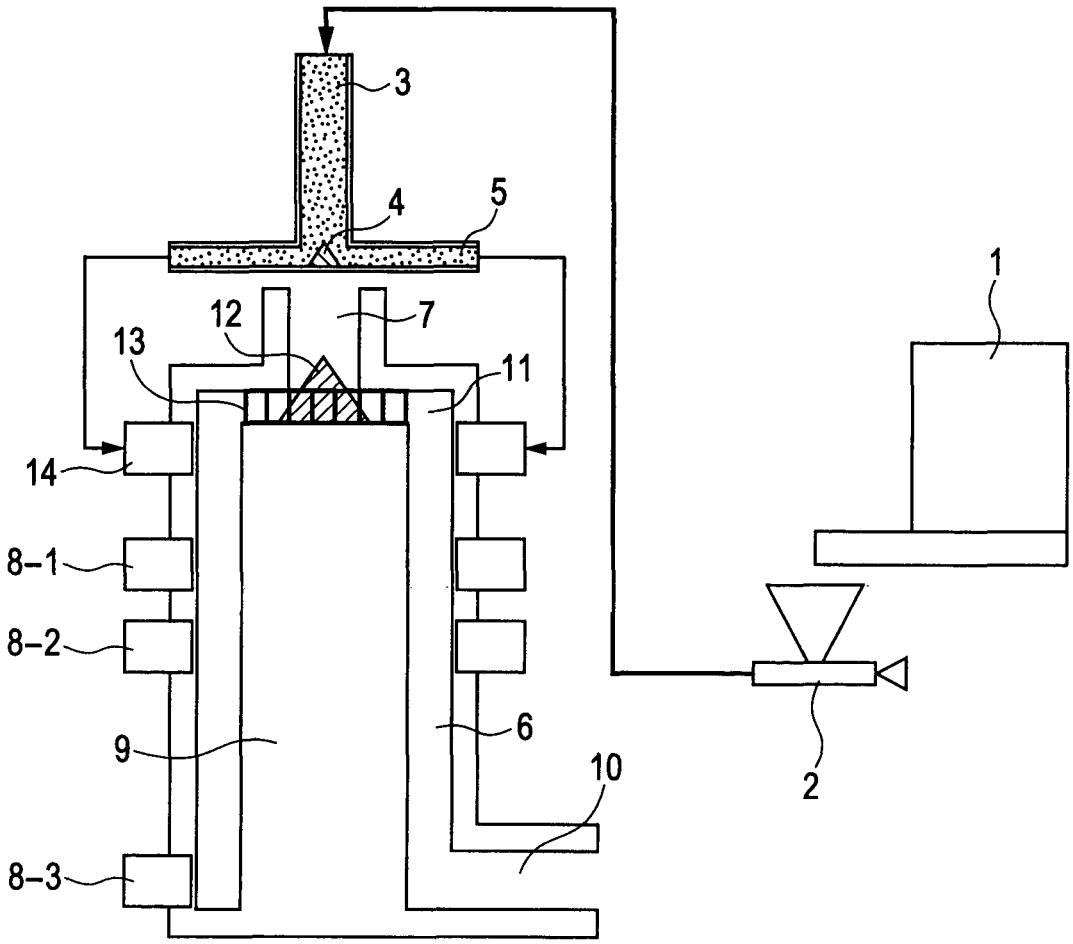
FIG. 1 is a cross-sectional schematic view illustrating one example of a heat treating apparatus of the present invention.

Hereinafter, the heat treating apparatus of the present invention will be schematically described with reference to the drawings. FIG. 1 is a cross-sectional schematic view illustrating one example of the heat treating apparatus of the present invention.

The powder particles quantitatively supplied by a raw material-quantitatively supplying unit 1 are led to an introducing tube 3 by compressed gas adjusted by a compressed gas flow rate adjustment unit 2. The introducing tube 3 is installed so that the direction of supplying the powder particles is a vertical direction. The powder particles having passed through the introducing tube 3 are uniformly dispersed by a conic protruding member 4 provided opposite to an outlet portion of the introducing tube, led to a supplying tube 5 having two or more (eight in FIG. 2) flow paths, and led to a treating chamber 6 in which a heat treatment is performed. Herein, a member having the protruding member 4 and the supplying tube 5 is referred to as a distributing member. In addition, a member having the introducing tube 3 and the distributing member is referred to as a raw material-supplying unit.

Such a conic protruding object is not limited to the above shape as long as the article can uniformly disperse the particles, and the article may have a polyhedron shape such as an eight-sided pyramid shape.

The supplying of the powder particles by using the introducing tube installed so that the direction of supplying powder particles is a vertical direction enables suppressing variation in flow speed in a pipe. In such a state, the powder particles are instantly distributed by the distributing member, so that the powder particles are supplied to the treating chamber in a nearly uniform state. A flow rate of air supplied from a compressed gas-adjusting unit can be within a range from 1.0 to 5.0 $m^3$/min. If the flow rate of air supplied from the compressed gas-adjusting unit is within the above range, the powder particles are favorably dispersed and the powder particles are heat-treated in the treating chamber of the heat treating apparatus in a nearly uniform state.

Figure 3:
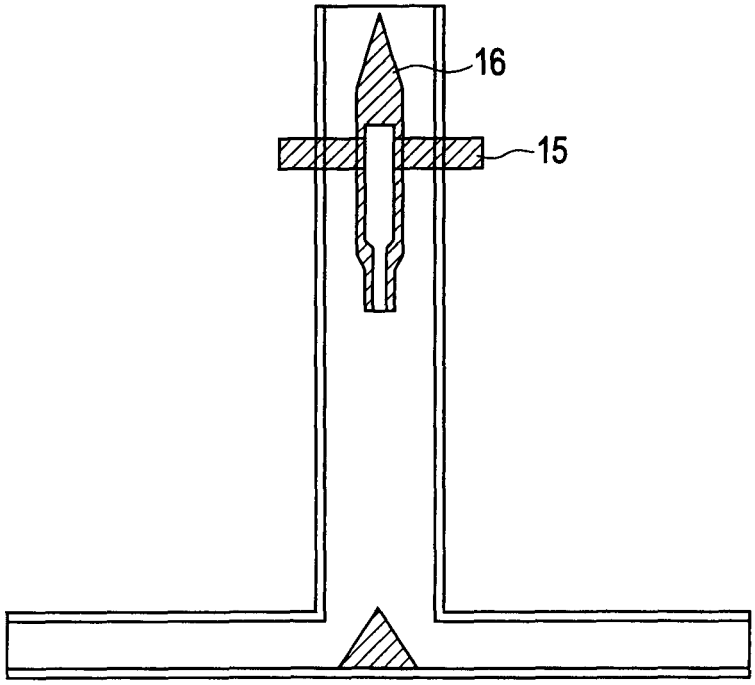
FIG. 3 is a cross-sectional view of a dispersing member of the raw material-supplying unit.
Figure 4:
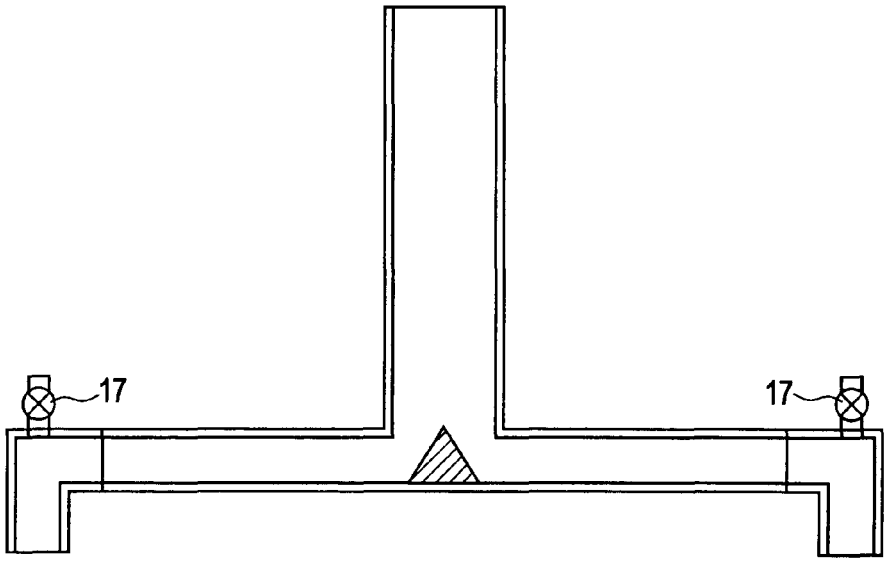
FIG. 4 is a cross-sectional view of a flow rate adjustment mechanism of the raw material-supplying unit.

Further, preferred results are obtained by introducing 0.5 to 1.5 $m^3$/min of air from a dispersion air-supplying port 15 on the upper portion of the introducing tube illustrated in FIG. 3. As illustrated in FIG. 3, the introducing tube is equipped with a dispersion air-supplying member 16 inside thereof, so that the powder particles are dispersed in a more preferred state. The dispersion air-supplying member 16 includes a columnar member with a conic tip and a bar member with a poly-sided pyramid tip, in terms of a shape. Further, as illustrated in FIG. 4, the adjusting of an amount of secondary air to be introduced to each flow path in a flow rate-adjusting unit 17 as a compressed air-injecting port or an external air-sucking port enables adjusting a flow rate of the powder particles in each flow path in a nearly uniform state. A fluctuation width of the flow speed of the powder particles in each supplying port can be adjusted within a range of ±0.5 m/s. Such a range can suppress generation of coarse particles.

The flow path that leads the powder particles to the heat treating chamber is present in two or more ways. In particular, the supplying tube has four or more flow paths and the flow paths extend radially outwardly from the protruding member toward the wall surface of the treating chamber, in a more preferable configuration. Especially, in the case where an amount of the powder particles to be supplied is 100 kg/h or more, the flow path that leads the powder particles to the heat-treating chamber is preferably present in 4 ways, and more preferably present in 8 ways. Taking a space for providing an introducing port to the heat treating apparatus into consideration, in the case where an internal diameter of the treating chamber of the heat treating apparatus (diameter) is 400 to 600 mm, the flow path that leads the powder particles to the heat treating chamber is particularly preferably present in 8 ways. An increase in number of distributing flow paths enables a more decrease in concentration of the powder particles immediately after being introduced from each supplying port to the heat treating chamber, thereby enabling heat-treating the powder particles in a more nearly uniform state. This increase can suppress generation of coalesced particles and also can make a circularity distribution of the powder particles after the heat treatment sharp.

Figure 5:
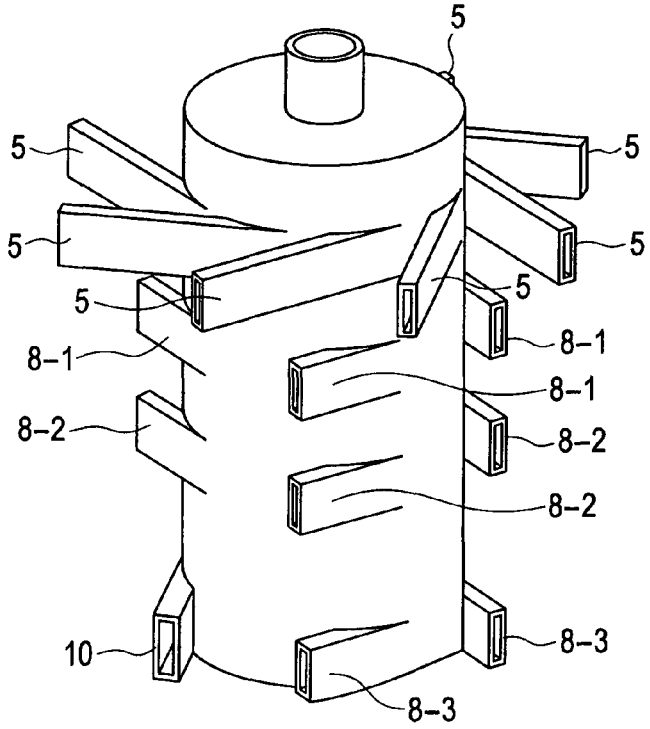
FIG. 5 is a cross-sectional perspective view of a main unit of the heat treating apparatus.

As illustrated in FIG. 1 and FIG. 5, the heat treating apparatus of the present invention has a cylindrical treating chamber 6 in which a heat treatment of a toner is performed.

Hot air for heat-treating the supplied powder particles is supplied from a hot air-supplying unit 7 illustrated in FIG. 1. For the hot air supplied to the treating chamber, a temperature at an outlet portion of the hot air-supplying unit 7 can be 100° C. to 300° C. If the temperature at an outlet portion of the hot air-supplying unit is within the above range, the powder particles can be spheroidization-treated in a nearly uniform state while suppressing melt-adhesion or fusion and coalescence of the powder particles due to heating the powder particles too much.

The heat-treated powder particles are further cooled by cold air to be supplied from a cold air-supplying unit 8-1, 8-2, and 8-3.

A temperature of cold air to be supplied from the cold air-supplying unit 8-1, 8-2, and 8-3 can be −20° C. to 30° C. If the temperature of cold air is within the above range, the powder particles can be effectively cooled, and fusion and coalescence of the powder particles can be suppressed without inhibiting a uniform spheroidization treatment of the powder particles.

The inside of the treating chamber can be cooled by a cooling jacket in order to prevent fusion of the powder particles. Cooling water (that can be an antifreeze liquid such as ethylene glycol) can be introduced to the cooling jacket, and a surface temperature of the cooling jacket can be 40° C. or lower.

At this time, a flow of the powder particles supplied to the treating chamber is regulated by a regulating unit 5 provided in the treating chamber, for regulating the flow of the powder particles. Consequently, the powder particles supplied to the treating chamber are heat-treated while rotating along the inner wall surface in the treating chamber in a spiral manner, and then cooled.

Then, the cooled powder particles are recovered by a recovering unit 10 at the lower end of the treating chamber. Herein, the recovering unit has such a configuration that a blower (not illustrated) is provided at the tip of the unit and suction by the blower allows the particles to be conveyed.

An outlet 11 of the hot air-supplying unit of the heat treating apparatus is opposite to the upper end portion of the columnar member 9. Further, the columnar member 9 is equipped with a substantially conic hot air-distributing member 12 for distributing the supplied hot air in a circumferential direction, on the central portion of the upper end portion of the member.

Figure 7:
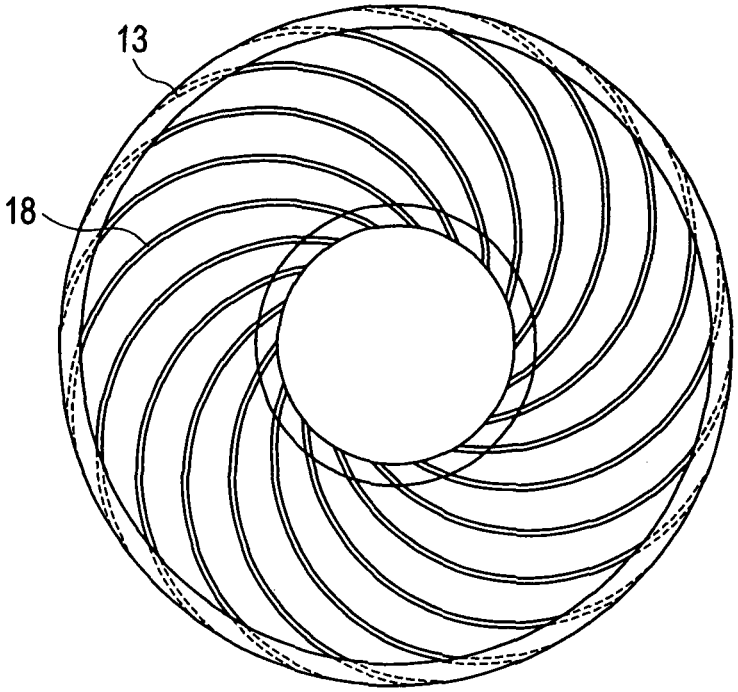
FIG. 7 illustrates a turning member to be used for the main unit of the heat treating apparatus.

The turning member 13 for turning hot air may have such a configuration that enables introducing hot air so as to rotate the hot air along the inner wall surface in the treating chamber in a spiral manner. According to such a configuration, the rotating member 13 for rotating hot air has a plurality of blades 18, as illustrated in FIG. 7, and rotation of hot air can be controlled depending on the number and angle of the blades.

Herein, the columnar member 9 can be provided with a cooling jacket in order to prevent fusion of the powder particles.

The turning member 13 for turning hot air is provided such that a direction of rotating hot air is the same direction as a direction of rotating the supplied powder particles.

The direction of rotating the powder particles supplied to the treating chamber is the same as the direction of rotating hot air, so that a turbulent flow does not occur in the treating chamber. Accordingly, collision between the powder particles is decreased and coalescence of the powder particles is decreased, thereby enabling obtaining a toner having a uniform shape.

The recovering unit 10 of the heat treating apparatus is provided on the peripheral portion of the treating chamber so as to maintain the direction of rotating the powder particles that rotates in a spiral manner.

The columnar member 9 of the regulating unit for regulating a flow of the powder particles can have a substantially circular cross-section. The columnar member 9 may have such a configuration that a root portion of the columnar member 9 is thicker toward downstream of the treating chamber. Such a configuration can increase a flow speed of the powder particles on an end portion at the powder particle-recovering unit side to enhance discharging properties of the powder particles and to suppress adhesion and fusion as well as coalescence of the powder particles, on the recovering part.

In the heat treating apparatus of FIG. 1, the cold air to be supplied from the cold air-supplying unit is supplied from the peripheral portion of the apparatus to the inner peripheral surface of the treating chamber in horizontal and tangential directions, and thus adhesion of the powder particles to the wall surface of the treating chamber can be suppressed.

In addition, a direction of turning the cold air to be supplied from the cold air-supplying unit is the same as the direction of turning hot air, so that a turbulent flow does not occur in the treating chamber, thereby enabling suppressing coalescence of the powder particles.

In the heat treating apparatus, the powder particles to be supplied from the powder particle-supplying port 14 are supplied from the peripheral portion of the apparatus to the inner peripheral surface of the treating chamber in horizontal and tangential directions. Thus, a strong centrifugal force is applied to the powder particles supplied into the treating chamber to enhance dispersibility of the powder particles.

All of the direction of rotating the powder particles to be supplied from the powder supplying port, the direction of rotating the cold air supplied from the cold air-supplying unit, and the direction of rotating the hot air supplied from the hot air-supplying unit can be the same direction. Thus, a turbulent flow does not occur in the treating chamber, a rotational flow in the apparatus is stronger, a strong centrifugal force is applied to the powder particles, and dispersibility of the powder particles is further enhanced. Consequently, a toner with less coalesced particles and a uniform shape can be obtained.

Figure 6:
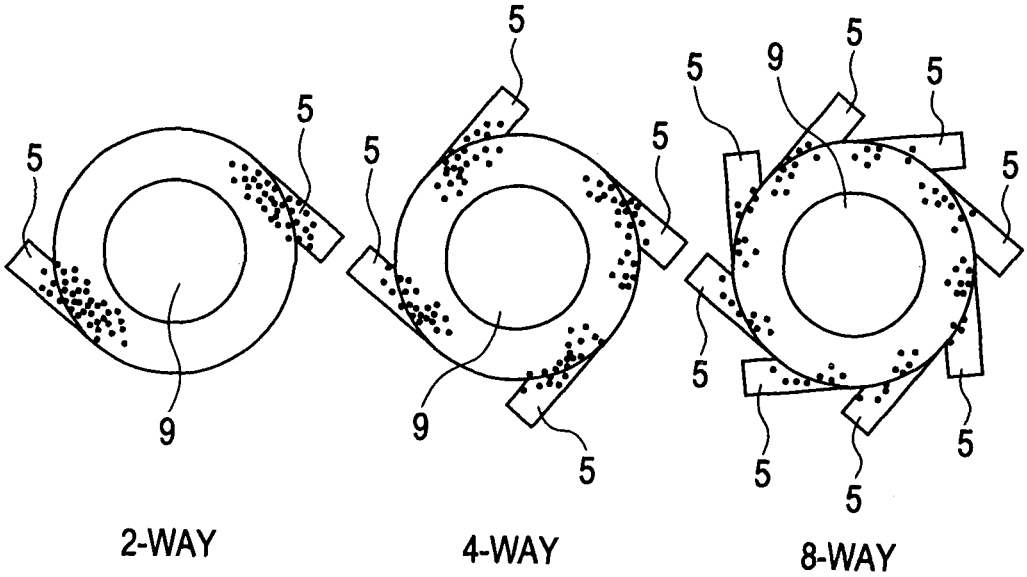
FIG. 6 is a plan view of a raw material-supplying port.

In the heat treating apparatus of FIG. 1, a plurality of the powder particle-supplying ports are provided in the same circumferential direction. As illustrated in FIG. 6, as the number of ways in the powder particle-supplying unit is larger, a dust concentration of the powder particles at the time of being introduced into the treating chamber is reduced. Thus, a temperature required for the heat treatment of the powder particle can be reduced. That is, at the same temperature, as the number of ways in the powder particle-supplying unit is larger, an average circularity of the powder particles after the heat treatment is higher.

A plurality of the cold air-supplying units can be provided at the downstream side of the powder particle-supplying unit.

Each cold air-supplying unit is located at the downstream side of the powder particle-supplying unit, thereby not cooling a heat treatment zone in the treating chamber by the introduced cold air to prevent a heat-treatment temperature required for spheroidization of the powder particles from excessively rising.

An air rate and temperature of the cold air introduced into the treating chamber can be independently controlled. Thus, as illustrated in FIG. 1, the cold air-supplying unit can be provided in a three-stage manner.

For example, the introduced cold air can be separated into cold air in the first stage (8-1), which is cold air having a function of efficiently sending the powder particles introduced into the treating chamber to a heat treatment zone; cold air in the second stage (8-2), which is cold air having a function of cooling the powder particles; and cold air in the third stage (8-3), which is cold air having a function of cooling the powder particle-recovering unit.

The heat treating apparatus of the present invention can be applied to powder particles obtained by a known production method such as a pulverizing method, a suspension polymerization method, an emulsion aggregation method, or a dissolution suspension method. Hereinafter, a procedure of producing a toner by a pulverizing method will be described.

In a raw material-mixing step, at least a resin and a colorant are weighed in predetermined amounts and blended as toner raw materials, and mixed. One example of a mixing apparatus includes HENSCHEL MIXER (manufactured by NIPPON COKE & ENGINEERING CO., LTD.); Super Mixer (Manufactured by KAWATA MFG Co., Ltd.); Ribocone (manufactured by OKAWARA MFG. Co., Ltd.); Nauta Mixer, Turbulizer, and Cyclomix (manufactured by Hosokawa Micron Corporation); Spiral Pin Mixer (manufactured by Pacific Machinery & Engineering Co., Ltd.); and Loedige Mixer (manufactured by Matsubo Corporation).

Further, the mixed toner raw materials are melted and kneaded in a melting and kneading step to melt resins and to disperse a colorant and the like therein. One example of a kneading apparatus includes a TEM extruder (manufactured by Toshiba Machine Co., Ltd.); a TEX twin-screw kneader (manufactured by The Japan Steel Works, LTD.); a PCM kneader (manufactured by Ikegai, Corp.); and KNEADEX (manufactured by NIPPON COKE & ENGINEERING CO., LTD.), and a continuous-type kneader such as a single- or twin-screw extruder is more preferable than a batch-type kneader from the viewpoint of advantages such as a capability of continuous production.

Further, a colored resin composition obtained by melting and kneading the toner raw materials is melted and kneaded, rolled by a two-roller or the like, and then cooled through a cooling step of cooling with water-cooling.

The cooled product of the colored resin composition, obtained as described above, is then pulverized so as to have a desired particle diameter in a pulverizing step. In the pulverizing step, the product is roughly pulverized by a crusher, a hammer mill, a feather mill or the like, and further finely pulverized by Kryptron System (manufactured by Kawasaki Heavy Industries, Ltd.), Super Rotor (manufactured by Nisshin Engineering Inc.) or the like to obtain toner fine particles.

The obtained toner fine particles are classified into surface-modified particles for toner having a desired particle diameter in a classification step. A classifier includes Turboplex, a TSP separator and a TTSP separator (manufactured by Hosokawa Micron Corporation); and ELBOW-JET (manufactured by Nittetsu Mining Co., Ltd.).

Subsequently, as a heat treatment step, the obtained toner particles are spheroidization-treated by using the heat treating apparatus of the present invention to obtain surface-modified particles.

After the surface modification, in order to sieve the coarse particles or the like, a sieving machine such as ULTRASONIC (manufactured by Koei Sangyo Co., Ltd.); Resona Sieve and Gyro Sifter (manufactured by Tokuju Corporation); Turbo Screener (manufactured by Turbo Kogyo Co., Ltd.); and HI-BOLTER (manufactured by TOYO HITEC CO., LTD.) may be used as required.

Herein, the heat treatment step may be performed after the above finely pulverizing or may be performed after the classification.

Then, constituent materials of a toner will be described.

As a binder resin, a known resin is used, and examples include homopolymers of a styrene derivative, such as polystyrene and polyvinyl toluene; styrene-type copolymers such as a styrene-propylene copolymer, a styrene-vinyl toluene copolymer, styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-octyl methacrylate copolymer, a styrene-dimethylaminoethyl methacrylate copolymer, a styrene-vinylmethylether copolymer, a styrene-vinylethylether copolymer, a styrene-vinylmethylketone copolymer, a styrene-butadiene copolymer, a styrene-isoprene copolymer, a styrene-maleic acid copolymer, and a styrene-maleate copolymer; polymethyl methacrylate, polybutyl methacrylate, polyvinyl acetate, polyethylene, polypropylene, polyvinylbutyral, a silicone resin, a polyester resin, a polyamide resin, an epoxy resin, a polyacrylic resin, rosin, modified rosin, a terpene resin, a phenol resin, an aliphatic or alicyclic hydrocarbon resin, and an aromatic petroleum resin, and these resins may be used alone or mixed.

In particular, a polymer that can be used as the binder resin is a polyester resin or a hybrid resin having a styrene-type copolymerizable unit and a polyester unit.

Examples of a polymerizable monomer to be used for the styrene-type copolymer include the following: styrene; styrene and derivatives thereof such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecyl styrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; a-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinylethers such as vinylmethylether, vinylethylether, and vinylisobutylether; vinylketones such as vinylmethylketone, vinylhexylketone, and methylisopropenylketone; N-vinyl compounds such as N-vinylpyrrole, N-vinylcarbazole, N-vinylindole, and N-vinylpyrrolidone; vinylnaphthalenes; and acrylate or methacrylate derivatives such as acrylonitrile, methacrylonitrile, and acrylamide.

Further, the monomer includes unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and an alkenylsuccinic anhydride; unsaturated dibasic acid half esters such as maleic acid methyl half ester, maleic acid ethyl half ester, maleic acid butyl half ester, citraconic acid methyl half ester, citraconic acid ethyl half ester, citraconic acid butyl half ester, itaconic acid methyl half ester, alkenylsuccinic acid methyl half ester, fumaric acid methyl half ester, and mesaconic acid methyl half ester; unsaturated dibasic acid esters such as dimethyl maleate and dimethyl fumarate; α,β-unsaturated acid such as acrylic acid, methacrylic acid, crotonic acid, and cinnamic acid; α,β-unsaturated acid anhydrides such as crotonic anhydride and cinnamic anhydride, and anhydrides of the α,β-unsaturated acids and lower fatty acids; and monomers each having a carboxyl group such as an alkenylmalonic acid, an alkenylglutaric acid, and an alkenyladipic acid, and anhydrides and monoesters of these acids.

Further, the monomer includes acrylates or methacrylates such as 2-hydroxyethyl acrylate, 2-hydroxyethyl methacrylate, and 2-hydroxypropyl methacrylate; and monomers each having a hydroxy group such as 4-(1-hydroxy-1-methylbutyl)styrene and 4-(1-hydroxy-1-methylhexyl)styrene.

The "polyester unit" means a moiety derived from polyester, and a component constituting the polyester unit includes an alcohol component and an acid component. The alcohol component includes a dihydric or more alcohol component, and the acid component includes divalent or more carboxylic acid, divalent or more carboxylic anhydride, and divalent or more carboxylate.

The dihydric alcohol monomer component includes alkylene oxide adducts of bisphenol A, such as polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxypropylene (2.0)-polyoxyethylene(2.0)-2,2-bis(4-hydroxyphenyl) propane, and polyoxypropylene(6)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, bisphenol A, and hydrogenated bisphenol A.

The trihydric or more alcohol monomer component includes sorbit, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methyl propanetriol, 2-methyl-1,2,4-butanetriol, trimethylol ethane, trimethylol propane, and 1,3,5-trihydroxyethyl benzene.

The divalent carboxylic acid monomer component includes aromatic dicarboxylic acids or anhydrides thereof, such as phthalic acid, isophthalic acid, and terephthalic acid; alkyldicarboxylic acids or anhydrides thereof such as succinic acid, adipic acid, sebacic acid, and azelaic acid; succinic acids substituted with an alkyl group or alkenyl group having 6 to 17 carbon atoms, or anhydrides thereof; and unsaturated dicarboxylic acids or anhydrides thereof such as fumaric acid, maleic acid, and citraconic acid.

The trivalent or more carboxylic acid monomer component includes polyvalent carboxylic acids such as trimellitic acid, pyromellitic acid, benzophenone tetracarboxylic acid, and anhydrides thereof.

In addition, other monomers include polyhydric alcohols such as oxyalkylether of a novolac phenol resin.

A colorant includes the following.

A black colorant includes carbon black; magnetic material; and a colorant toned in black by using a yellow colorant, a magenta colorant and a cyan colorant.

A coloring pigment for a magenta toner includes the following: a condensed azo compound, a diketopyrrolopyrrole compound, anthraquinone, a quinacridone compound, a base dye lake compound, a naphthol compound, a benzimidazolone compound, a thioindigo compound, and a perylene compound. Specifically, the pigment includes C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, 238, 254, 269; C.I. Pigment Violet 19, and C.I. Vat Red 1, 2, 10, 13, 15, 23, 29, 35.

For the colorant, a pigment may be used alone, but a dye and a pigment can be used in combination from the viewpoint of an image quality of a full color with improved sharpness.

A dye for a magenta toner includes the following: oil soluble dyes such as C.I Solvent Red 1, 3, 8, 23, 24, 25, 27, 30, 49, 81, 82, 83, 84, 100, 109, 121, C.I. Disperse Red 9, C.I. Solvent Violet 8, 13, 14, 21, 27, and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, 40, and C.I. Basic Violet 1, 3, 7, 10, 14, 15, 21, 25, 26, 27, 28.

A coloring pigment for a cyan toner includes the following: C.I. Pigment Blue 1, 2, 3, 7, 15:2, 15:3, 15:4, 16, 17, 60, 62, 66; C.I. Vat Blue 6, C.I. Acid Blue 45, and a copper phthalocyanine pigment in which 1 to 5 phthalimidomethyl groups are substituted with a phthalocyanine skeleton.

A coloring pigment for yellow includes the following: a condensed azo compound, an isoindoline compound, an anthraquinone compound, an azo metal compound, a methine compound, and an allylamide compound. Specifically, the pigment includes C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, 191; and C.I. Vat Yellow 1, 3, 20. A dye such as C.I. Direct Green 6, C.I. Basic Green 4, C.I. Basic Green 6, or Solvent Yellow 162 can also be used.

In the toner, the colorant is mixed with the binder resin in advance to form a master batch, which can be used. Then, this colorant master batch and other raw materials (such as binder resin and wax) are melted and kneaded, thereby enabling favorable dispersion of the colorant in the toner.

In the case where the colorant is mixed with the binder resin to form a master batch, dispersibility of the colorant does not deteriorate even if a large amount of the colorant is used, and dispersibility of the colorant in the toner particles is improved and color reproducibility such as mixing properties and clarity is excellent. A toner with a high covering power on a transferring material can also be obtained. In addition, the improvement in dispersibility of the colorant enables obtaining an image which is excellent in duration stability of toner chargeability and which maintains a high image quality.

Measurement methods will be described below.

<Measurement Method of Weight Average Particle Diameter (D4)>

Weight average particle diameters (D4) of powder particles and a toner are calculated as follows. As a measurement apparatus, a precise particle size distribution measurement apparatus "Coulter Counter Multisizer 3" (registered trademark, manufactured by Beckman Coulter, Inc.) equipped with a 100 μm aperture tube by a pore electric resistance method is used. Regarding setting of measurement conditions and analysis of measurement data, an attached dedicated software "Beckman Coulter Multisizer 3 Version 3.51" (manufactured by Beckman Coulter, Inc.) is used. Herein, the measurement is performed with the number of effective measurement channels of 25,000 channels.

As an electrolytic aqueous solution to be used for the measurement, a solution prepared by dissolving special grade sodium chloride in ion-exchange water in such a way as to have a concentration of about 1% by mass, for example, "ISOTON II" (produced by Beckman Coulter, Inc.), can be used.

Herein, prior to the measurement and the analysis, the dedicated software is set as described below.

In the screen of "Modification of the standard operating method (SOM)" of the dedicated software, the total count number in the control mode is set at 50,000 particles, the number of measurements is set at 1 time, and the Kd value is set at a value obtained by using "Standard particles 10.0 μm" (produced by Beckman Coulter, Inc.). The threshold value and the noise level are automatically set by pressing "Threshold value/noise level measurement button". The current is set at 1,600 μA, the gain is set at 2, the electrolytic solution is set at ISOTON II, and a check mark is placed in "Post-measurement aperture tube flush".

In the screen of "Setting of conversion from pulses to particle diameter" of the dedicated software, the bin interval is set at a logarithmic particle diameter, the particle diameter bin is set at 256 particle diameter bins, and the particle diameter range is set at 2 μm to 60 μm.

The specific measurement process is as described below.

(1) About 200 ml of the electrolytic aqueous solution is charged in a 250 ml round-bottom glass beaker dedicated to Multisizer 3, the beaker is set in a sample stand, and counterclockwise stirring is performed with a stirrer rod at 24 revolutions/sec. Then, contamination and air bubbles in the aperture tube are removed by "Aperture flush" function of the dedicated software.

(2) About 30 ml of the electrolytic aqueous solution is charged in a 100 ml flat-bottom glass beaker. A diluted solution is prepared by diluting "Contaminon N" (a 10% by mass aqueous solution of a neutral detergent for washing a precision measuring device, including a nonionic surfactant, an anionic surfactant and an organic builder, and having a pH of 7, produced by Wako Pure Chemical Industries, Ltd.) with ion-exchange water by a factor of about 3 on a mass basis, and about 0.3 ml of the diluted solution is added into the beaker as a dispersing agent.

(3) An ultrasonic dispersion device "Ultrasonic Dispersion System Tetora 150" (manufactured by Nikkaki Bios Co., Ltd.) is prepared, the device incorporating two oscillators with an oscillatory frequency of 50 kHz so that the phases are displaced by 180 degrees and having an electrical output of 120 W. Then, about 3.3 l of ion-exchange water is charged into a water tank of the ultrasonic dispersion device, and about 2 ml of Contaminon N is added into this water tank.

(4) The beaker in the (2) is set in a beaker fixing hole of the above ultrasonic dispersion system, and the ultrasonic dispersion device is actuated. The height position of the beaker is adjusted so that the resonance state of the liquid surface of the electrolytic aqueous solution in the beaker is maximized.

(5) While the electrolytic aqueous solution in the beaker of the (4) is irradiated with an ultrasonic wave, about 10 mg of a toner is added to the electrolytic aqueous solution little by little and is dispersed.

Subsequently, an ultrasonic dispersion treatment is further continued for 60 seconds. Herein, in the ultrasonic dispersion, the water temperature of the water tank is appropriately controlled so as to be 10° C. or higher and 40° C. or lower.

(6) The electrolytic aqueous solution, in which the toner is dispersed, of the item (5) is dropped to the round-bottom beaker of the (1) set in the sample stand by using a pipette so that the measurement concentration is adjusted to be about 5%. Then, the measurement is performed until the number of measured particles reaches 50,000.

(7) The measurement data is analyzed by the dedicated software attached to the apparatus, and the weight average particle diameter (D4) is calculated. Herein, when Graph/% by volume is set in the dedicated software, "Average diameter" on the screen of "Analysis/statistical value on volume (arithmetic average)" is the weight average particle diameter (D4).

<Calculating Method for Amount of Fine Powder>

An amount (% by number) of the fine powder on the number basis in the powder particles or the toner is calculated by analyzing data after the measurement with Multisizer 3.

For example, % by number of particles of 4.0 μm or less in the toner is calculated by the following procedure. First, the chart of the measurement results is displayed in terms of % by number by setting the dedicated software to "Graph/% by number". Then, a check mark is placed in "<" of the particle diameter-setting portion on the screen of "Format/particle diameter/particle diameter statistics", and "4" is input in the particle diameter-inputting portion below the particle diameter-setting portion. The numerical value in the display portion of "<4 μm" when the screen of "Analysis/statistical value on number (arithmetic average)" is displayed is the % by number of the particles of 4.0 μm or less in the toner.

<Calculating Method for Amount of Coarse Powder>

An amount (% by volume) of the coarse powder on the volume basis in the powder particles or the toner is calculated by analyzing data after the measurement with Multisizer 3.

For example, % by volume of particles of 10.0 μm or more in the toner is calculated by the following procedure. First, the chart of the measurement results is displayed in terms of % by volume by setting the dedicated software to "Graph/% by volume". Then, a check mark is placed in ">" of the particle diameter-setting portion on the screen of "Format/particle diameter/particle diameter statistics", and "10" is input in the particle diameter-inputting portion below the particle diameter-setting portion. The numerical value in the display portion of ">10 μm" when the screen of "Analysis/statistical value on volume (arithmetic average)" is displayed is the % by volume of the particles of 10.0 μm or more in the toner.

<Measurement Method of Average Circularity>

The average circularities of the powder particles and the toner are measured with a flow-type particle image analyzing apparatus "FPIA-3000" (manufactured by SYSMEX CORPORATION) under measurement and analysis conditions at the time of a calibration operation.

A specific measurement method is as follows. First, about 20 ml of ion-exchange water in which an impure solid and the like are previously removed is charged in a glass vessel. A diluted solution is prepared by diluting "Contaminon N" (a 10% by mass aqueous solution of a neutral detergent for washing a precision measuring device, including a nonionic surfactant, an anionic surfactant and an organic builder, and having a pH of 7, produced by Wako Pure Chemical Industries, Ltd.) with ion-exchange water by a factor of about 3 on a mass basis, and about 0.2 ml of the diluted solution is added into the vessel as a dispersing agent. About 0.02 g of a measurement specimen is further added and subjected to a dispersing treatment using an ultrasonic dispersion device for 2 minutes to obtain a dispersion for measurement. In this regard, the dispersion is appropriately cooled so as to have a temperature of 10° C. or higher and 40° C. or lower. A desktop type ultrasonic washer disperser ("VS-150" (manufactured by Velvo-Clear Co., Ltd.)) with an oscillation frequency of 50 kHz and an electric output of 150 W is used as an ultrasonic dispersion device, a predetermined amount of ion-exchange water is charged in a water tank, and about 2 ml of the Contaminon N is added into the water tank.

For the measurement, the flow-type particle image analyzing apparatus with a standard objective lens (magnification: 10×) mounted was used and Particle Sheath "PSE-900A" (produced by SYSMEX CORPORATION) was used as a sheath fluid. The dispersion prepared according to the procedure is introduced into the flow-type particle image analyzing apparatus and 3000 toner particles are measured according to an HPF measurement mode and a total count mode. The average circularity of the toner or the powder particles is determined with a binarization threshold at the time of particle analysis being set to 85% and particle diameters to be analyzed being limited to diameters each corresponding to a circle-equivalent diameter of 1.985 μm or more and less than 39.69 μm.

When measuring, prior to initiating the measurement, automatic focusing is performed by using standard latex particles (obtained by diluting "RESEARCH AND TEST PARTICLES Latex Microsphere Suspensions 5200A" produced by Duke Scientific with ion-exchange water). Thereafter, focusing can be carried out every two hours from the initiation of the measurement.

It is to be noted that, in Examples of the present application, a flow-type particle image analyzing apparatus which had been subjected to a calibration operation by SYSMEX CORPORATION, and which had received a calibration certificate issued by SYSMEX CORPORATION was used. The measurement was performed under the same measurement and analysis conditions as conditions at the time of the reception of the calibration certificate except that particle diameters to be analyzed were limited to diameters each corresponding to a circle-equivalent diameter of 1.985 μm or more and less than 39.69 μm.

EXAMPLES

Polyester Resin 1

The following materials were weighed and added into a reaction tank equipped with a condenser tube, a stirrer and a nitrogen-introducing tube.

| | |
|---|---|
| Terephthalic acid | 17.6 parts by mass |
| Polyoxyethylene(2.2)-2,2-bis(4-hydroxyphenyl) propane | 76.2 parts by mass |
| Titanium dihydroxybis(triethanolaminate) | 0.2 parts by mass |

Thereafter, the resultant mixture was heated to 220° C. and reacted for 8 hours while introducing nitrogen and removing water generated. Thereafter, 1.5 parts by mass of trimellitic anhydride was added, heated to 180° C., and reacted for 4 hours to synthesize a polyester resin 1.

The polyester resin 1 had a weight average molecular weight (Mw) of 82400, a number average molecular weight (Mn) of 3300 and a peak molecular weight (Mp) of 8450, determined by GPC, and had a glass transition temperature (Tg) of 63° C. and a softening point (½ method) of 110° C.

(Production Example of Toner Particles)

| | |
|---|---|
| Polyester resin 1: | 100 parts by mass |
| Paraffin wax: | 5 parts by mass |

(Peak Temperature of Maximum Endothermic Peak: 78° C.)

| | |
|---|---|
| Aluminum 3,5-di-t-butylsalicylate compound: | 1.0 part by mass |
| C.I. Pigment Blue 15:3: | 5 parts by mass |

The above formulated materials were mixed by HENSCHEL MIXER (FM-75 model) (manufactured by Mitsui Miike Chemical Engineering Machinery, Co., Ltd.), and then kneaded by a twin-screw kneader (PCM-30 model) (manufactured by Ikegai Corp.) set at a temperature of 120° C. The kneaded product obtained was cooled and roughly pulverized to 1 mm or less by a hammer mill to form a toner-roughly pulverized product, and the toner-roughly pulverized product obtained was pulverized by a mechanical pulverizer, T-250 (manufactured by Turbo Kogyo Co., Ltd.), to obtain toner fine particles. Subsequently, the obtained toner fine particles were classified by a multi-division classifier utilizing a Coanda effect.

The toner particles obtained in this case had a weight average diameter (D4) of 6.0 μm, 30% by number of particles of 4.0 μm or less, and 0.5% by volume of particles of 10.0 μm or more. In addition, the circularity of the obtained toner fine particles was measured by FPIA 3000, and as a result, the average circularity was 0.941. Hereinafter, the toner particles are designated as toner particles A.

Further, the following materials were charged to a HENSCHEL MIXER (FM-75 model, manufactured by NIPPON COKE & ENGINEERING CO., LTD.), and mixed at a circumferential speed of a rotation blade of 50.0 m/sec and a mixing time of 3 minutes to obtain mother particles obtained by adhering silica and titanium oxide on the surfaces of the toner particles A.

| | |
|---|---|
| Powder particles for toner A: | 100 parts by mass |
| Silica: | 3.0 parts by mass |

(obtained by subjecting silica fine particles prepared by a sol-gel method to a surface treatment with 1.5% by mass of hexamethyldisilazane, and adjusting the particles by classification so as to have a desired particle size distribution)

| | |
|---|---|
| Titanium oxide: | 0.5 parts by mass |

(obtained by subjecting metatitanic acid having anatase crystallinity to a surface treatment)

Example 1

Figure 2:
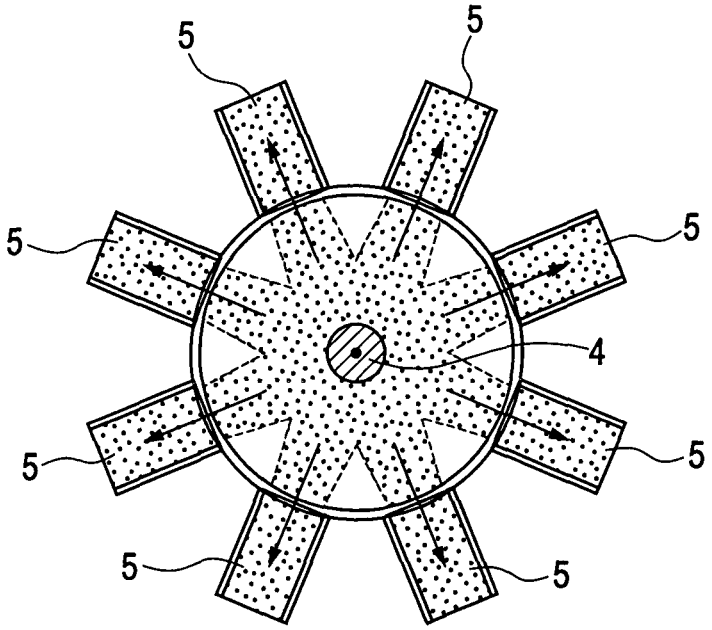
FIG. 2 is a plan view illustrating one example of a raw material-supplying unit to be used in the present invention.

The heat treating apparatus illustrated in FIG. 1 was used to perform a heat treatment. As the raw material-supplying unit, a unit in which a branching flow path for supplying raw materials was branched in 8 directions, as illustrated in FIG. 2, was used. An internal structure of the raw material-supplying unit having eight flow paths in FIG. 2 will now be described. An internal diameter of the supplying tube 5 is 50 mm in diameter, and the tube 5 is connected to the supplying port 14 (diameter 50 mm) of the heat treating apparatus through a pipe. The raw material-supplying unit in FIG. 2 has eight triangular edges arranged thereon in order to introduce powder particles to the supplying tube 5 in multiple ways. The distributing member 4 used had a conic shape, a height of 40 mm, and a diameter of 40 mm. The dispersion air-supplying member illustrated in FIG. 3 was used in the inside of the introducing tube of the raw material-supplying unit. Air was introduced from the dispersion air-supplying port. Further, the flow rate adjustment mechanism described in FIG. 4 was used in order to make a flow amount in each raw material-supplying pathway uniform, and was adjusted so that a flow speed of each flow path was 10.0 m/s. An internal diameter of the treating chamber of the heat treating apparatus was 450 mm in diameter, and an external diameter of the regulating unit (columnar member 9) was 320 mm in diameter.

The apparatus having the above configuration was used to heat-treat toner particles A.

Operation conditions in this case were as follows: feed amount=150 kg/hr, hot air temperature=165° C., air rate of hot air=27.0 $m^3$/min, total amount of cold air=14.0 $m^3$/min (cold air-supplying unit 8-1: 6.0 $m^3$/min, cold air-supplying unit 8-2: 2.0 $m^3$/min, cold air-supplying unit 8-3: 6.0 $m^3$/min), air rate of compressed gas=3.0 $m^3$/min, amount of dispersion air=1.5 $m^3$/min, and air rate of blower=50.0 $m^3$/min. A flow speed of each supplying port was adjusted within a range of 10.0±0.1 m/s by the flow rate adjustment mechanism, and an operation time was 1 hour. A configuration of the raw material-supplying unit is shown in Table 1, and flow speeds of flow paths A to H of the supplying tube of the raw material-supplying unit are shown in Table 2.

In a particle size distribution of the heat-treated particles obtained in this case, a weight average diameter was 6.3 μm, a percentage of particles having a particle diameter of 4.0 μm or less was 27.5% by number, a percentage of particles of 10.0 μm or more was 3.1% by volume, and an average circularity was 0.968. Further, a frequency of particles having a circularity of 0.990 or more in a circularity distribution was 24.4%. Further, a number of the raw material-quantitatively supplying unit was one, and an occupied space was 1.5 $m^2$.

The following items were evaluated as for Example 1.

<Evaluation for Average Circularity>

The following criteria were used to evaluate the average circularity e of obtained heat-treated particles.

A: 0.965≤e

B: 0.960≤e<0.965

C: e<0.960

<Evaluation for Amount of Coarse Powder>

As an indicator of the amount of the coarse powder contained in the heat-treated particles obtained, a percentage s (% by volume) of particles having a particle diameter of 10.0 μm or more in the heat-treated particles was determined according to the following criteria.

A: s<5.0

B: 5.0≤s<10.0

C, 10.0≤s<15.0

D: 15.0≤s<20.0

E: 20.0≤s

<Evaluation for Frequency of Particles Having Circularity of 0.990 or More>

The mother particles were heat-treated at an amount to be treated of 150 kg/hr so as to obtain heat-treated particles having an average circularity of 0.970. Then, a frequency b (%) of particles having a circularity of 0.990 or more in the obtained heat-treated particles was evaluated according to the following criteria.

A: b<25.0

B: 25.0≤b<30.0

C: 30.0≤b<35.0

D: 35.0≤b<40.0

E: 40.0≤b

<Evaluation for Occupied Space by Quantitatively Supplying Machine>

Assuming that an occupied space per installed raw material-quantitatively supplying unit was 1.5 $m^2$, an occupied space by a quantitatively supplying machine was calculated. As the occupied space by the quantitatively supplying machine required for achieving the certain amount to be treated is increased, space efficiency is reduced. These results and evaluations were summarized in Table 3.

Example 2

A heat treatment of toner particles A was performed by using the heat treating apparatus illustrated in FIG. 1 in the same manner as in Example 1 except that a flow speed of each supplying port was adjusted within 10.0±0.3 m/s by the flow rate adjustment mechanism. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 3

A heat treatment of toner particles A was performed by using the heat treating apparatus illustrated in FIG. 1 in the same manner as in Example 1 except that a flow speed of each supplying port was adjusted within 10.0±0.5 m/s by the flow rate adjustment mechanism. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 4

A heat treatment of toner particles A was performed by using the heat treating apparatus illustrated in FIG. 1 under the same conditions as in Example 1 except that an amount to be treated was 170 kg/h.

A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 5

A heat treatment of toner particles A was performed by using the heat treating apparatus illustrated in FIG. 1 in the same manner as in Example 1 except that the dispersion air-supplying member 16 in FIG. 3 was omitted. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 6

A heat treatment of toner particles A was performed by using the heat treating apparatus illustrated in FIG. 1 in the same manner as in Example 5 except that a flow speed of the supplying port of the raw material-supplying unit was not adjusted. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 7

A heat treatment of toner particles A was performed by using the heat treating apparatus illustrated in FIG. 1 in the same manner as in Example 6 except that a flow rate of the dispersion air was 1.0 $m^3$/min. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 8

A heat treatment of toner particles A was performed by using the heat treating apparatus illustrated in FIG. 1 in the same manner as in Example 6 except that a flow rate of the dispersion air was 0.5 $m^3$/min. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 9

A heat treatment of toner particles A was performed by using the same heat treating apparatus as in Example 1 except that the diffusing member and the flow rate adjustment mechanism was not equipped and the dispersion air was not supplied. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Example 10

A heat treatment of toner particles A was performed by using the same heat treating apparatus as in Example 9 except that a configuration in which the number of the flow paths of the raw material-supplying unit was 4 (flow paths on every other path were sealed and the other four flow paths were opened among the eight flow paths in FIG. 2) was adopted. A configuration of the raw material-supplying unit was summarized in Table 1, flow speeds of flow paths A, C, E, and G of the supplying tube of the raw material-supplying unit were summarized in Table 2, and a particle diameter and evaluation of the heat-treated particles obtained were summarized in Table 3.

Example 11

A heat treatment of toner particles A was performed by using the same heat treating apparatus as in Example 9 except that a configuration in which the number of the flow paths of the raw material-supplying unit was 2 (only two flow paths opposite to each other were opened and the other flow paths were sealed among the eight flow paths in FIG. 2) was adopted. A configuration of the raw material-supplying unit was summarized in Table 1, flow speeds of flow paths A and E of the supplying tube of the raw material-supplying unit were summarized in Table 2, and a particle diameter and evaluation of the heat-treated particles obtained were summarized in Table 3.

Comparative Example 1

Figure 8:
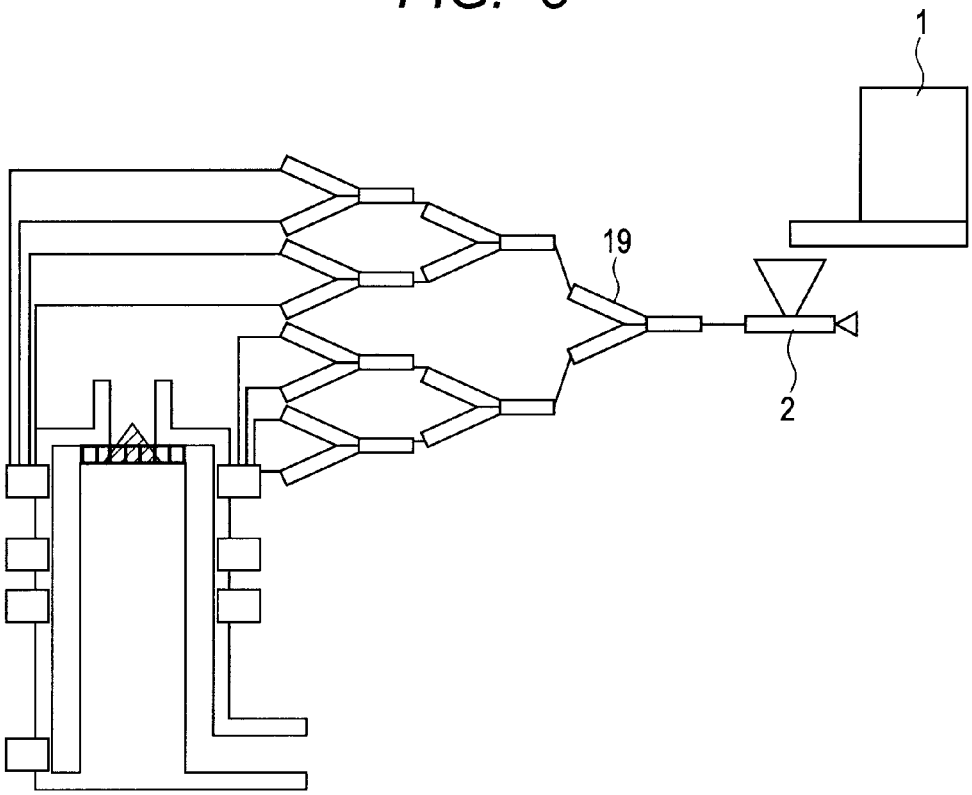
PRIOR ART FIG. 8
FIG. 8 is a schematic view of a heat treating apparatus and a supplying unit in Comparative Example 1.

A heat treatment of toner particles A was performed by using the heat treating apparatus illustrated in FIG. 8. As the raw material-supplying unit, a unit was used in which seven branching tubes 19 described in FIG. 8 were used to branch a branching flow path for supplying raw materials to 8 directions. A heat treatment of toner particles A was performed with the other conditions being the same conditions as in Example 9. A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Comparative Example 2

A heat treatment of toner particles A was performed by using as the raw material-supplying unit, a unit in which three branching tubes 19 were used to branch a branching flow path for supplying raw materials to 4 directions, and using the other configurations under the same conditions as in Comparative Example 1. A configuration of the raw material-supplying unit was summarized in Table 1, flow speeds of flow paths A, C, E, and G of the supplying tube of the raw material-supplying unit were summarized in Table 2, and a particle diameter and evaluation of the heat-treated particles obtained were summarized in Table 3.

Comparative Example 3

Figure 9:
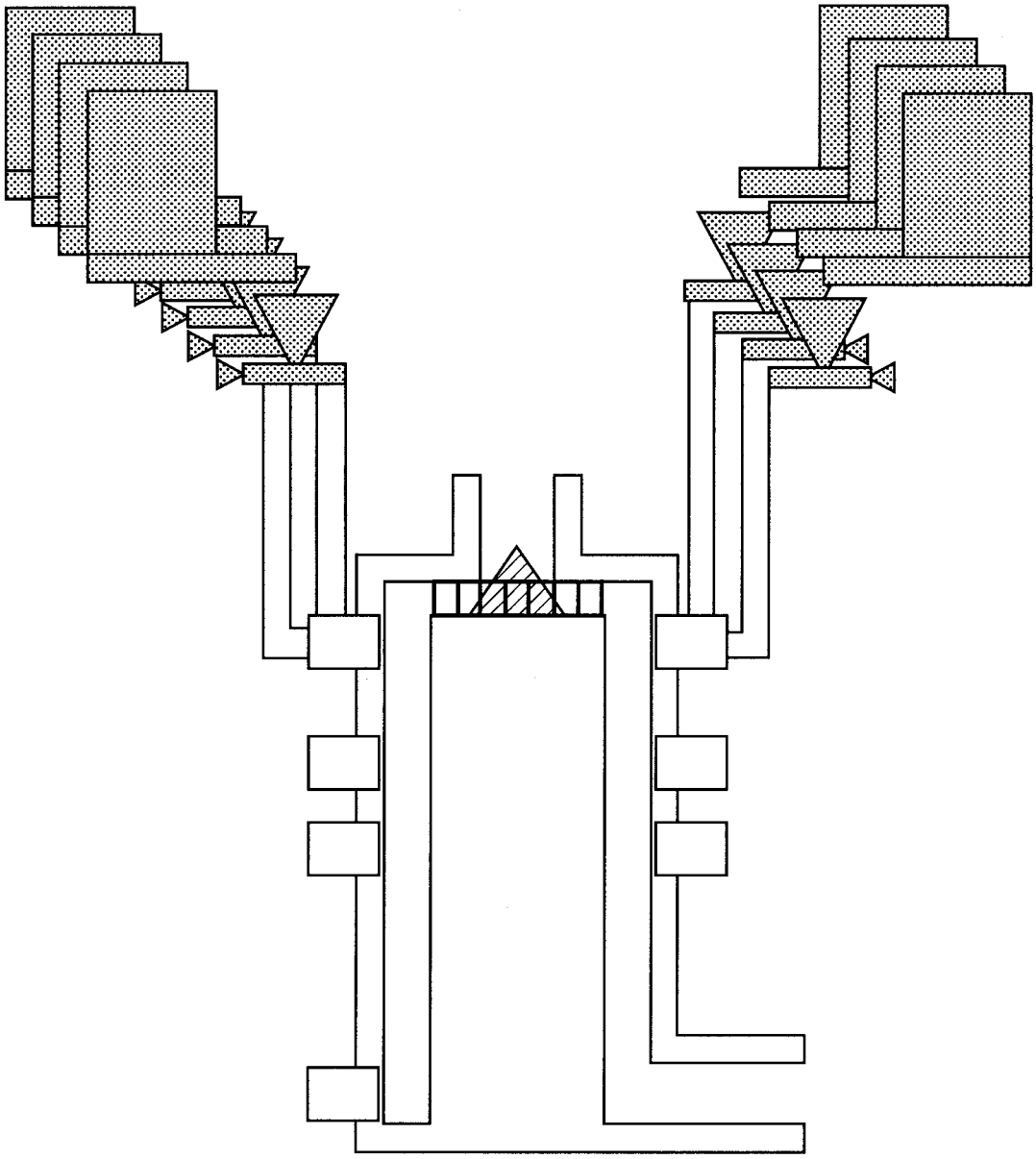
PRIOR ART FIG. 9
FIG. 9 is a schematic view of a heat treating apparatus on which a plurality of supplying parts are provided.

A heat treatment of toner particles A was performed by using the heat treating apparatus equipped with eight raw material-quantitatively supplying machines illustrated in FIG. 9. An amount to be supplied by each quantitatively supplying machine was adjusted to 18.8 kg/h (150 kg/h in total of eight machines), and an amount of compressed air was adjusted to 0.5 $m^3$. A heat treatment of toner particles A was performed with the other conditions being the same conditions as in Example 9.

A configuration of the raw material-supplying unit was summarized in Table 1, flow speeds of flow paths A to H of the supplying tube of the raw material-supplying unit were summarized in Table 2, and a particle diameter and evaluation of the heat-treated particles obtained were summarized in Table 3.

Examples 12 to 22 and Comparative Examples 4 to 6

In each production condition of Examples 1 to 11 and Comparative Examples 1 to 3, a hot air temperature was adjusted so that an average circularity of heat-treated particles to be obtained was 0.970. Then, a frequency of particles having a circularity of 0.990 or more in the heat-treated particles obtained was evaluated according to the above. The hot air temperature and evaluation result in this case were summarized in Table 4.

Reference Example 1

A heat treatment of toner particles A was performed under the same conditions as in Example 1 except that a variation width of a flow speed of each supplying port was within ±1.0 m/s by the flow rate adjustment mechanism. A configuration of the raw material-supplying unit was summarized in Table 1, flow speeds of the supplying ports of the raw material-supplying unit were summarized in Table 2, and a particle diameter and evaluation of the heat-treated toner particles obtained were summarized in Table 3. Herein, the present Reference Example was performed for the purpose of clarifying an effect when a flow speed varied to a range that could not occur in a usual raw material-supplying unit.

TABLE 1

| | Number of flow paths | Dispersion air | Amount of dispersion air ($m^3$/min) | Flow rate adjustment mechanism | Flow rate adjustable range (m/s) | Diffusing member |
|---|---|---|---|---|---|---|
| Example 1 | 8 | Present | 1.5 | Present | 10.0 ± 0.1 | Present |
| Example 2 | 8 | Present | 1.5 | Present | 10.0 ± 0.3 | Present |
| Example 3 | 8 | Present | 1.5 | Present | 10.0 ± 0.5 | Present |
| Example 4 | 8 | Present | 1.5 | Present | 10.0 ± 0.1 | Present |
| Example 5 | 8 | Present | 1.5 | Present | 10.0 ± 0.1 | — |
| Example 6 | 8 | Present | 1.5 | — | — | — |
| Example 7 | 8 | Present | 1.0 | — | — | — |
| Example 8 | 8 | Present | 0.5 | — | — | — |
| Example 9 | 8 | Absent | — | — | — | — |
| Example 10 | 4 | Absent | — | — | — | — |
| Example 11 | 2 | Absent | — | — | — | — |
| Comparative Example 1 | — | Absent | — | — | — | |
| Comparative Example 2 | — | Absent | — | — | — | — |
| Comparative Example 3 | — | Absent | — | — | — | — |
| Reference Example 1 | 8 | Present | — | — | 10.0 ± 1.0 | — |

TABLE 2

| | A | B | C | D | E | F | G | H |
|---|---|---|---|---|---|---|---|---|
| Example 1 | 10.0 | 10.1 | 10.0 | 9.9 | 10.0 | 10.0 | 9.9 | 10.1 |
| Example 2 | 10.0 | 10.2 | 10.1 | 9.8 | 10.3 | 9.7 | 9.9 | 10.1 |
| Example 3 | 10.0 | 10.2 | 10.5 | 9.6 | 10.5 | 9.5 | 10.2 | 10.1 |
| Example 4 | 10.0 | 10.1 | 10.1 | 9.9 | 10.1 | 9.9 | 10.0 | 10.1 |
| Example 5 | 10.0 | 10.1 | 10.1 | 10.1 | 9.9 | 9.9 | 10.0 | 10.1 |
| Example 6 | 10.5 | 10.2 | 9.6 | 9.4 | 10.7 | 9.6 | 10.7 | 9.4 |
| Example 7 | 10.4 | 9.6 | 10.6 | 9.3 | 10.6 | 10.7 | 9.7 | 10.2 |
| Example 8 | 10.4 | 10.0 | 9.3 | 9.5 | 10.6 | 10.7 | 9.4 | 10.2 |
| Example 9 | 10.3 | 9.2 | 9.9 | 10.8 | 10.3 | 10.6 | 9.4 | 10.1 |
| Example 10 | 20.6 | — | 19.3 | — | 19.2 | — | 20.5 | — |

TABLE 2-continued

| | A | B | C | D | E | F | G | H |
|---|---|---|---|---|---|---|---|---|
| Example 11 | 39.4 | — | — | — | 40.4 | — | — | — |
| Comparative Example 1 | 10.2 | 8.9 | 9.6 | 11.2 | 11.1 | 9.1 | 9.3 | 10.6 |
| Comparative Example 2 | 19.5 | — | 21.5 | — | 20.6 | — | 19.3 | — |
| Comparative Example 3 | 9.9 | 9.1 | 9.6 | 10.1 | 10.7 | 10.9 | 10.4 | 10.2 |
| Reference Example 1 | 10.0 | 10.7 | 9.5 | 9.1 | 11.0 | 9.0 | 10.9 | 9.2 |

TABLE 3

| | Toner particle size | | | Circularity | | | Evaluation result | |
|---|---|---|---|---|---|---|---|---|
| | D4 (μm) | 4.0 μm or less (% by number) | 10.0 μm or more (% by volume) | Average circularity | 0.990 or more (%) | Occupied space ($m^2$) | Coarse powder amount | Circularity |
| Example 1 | 6.3 | 27.5 | 3.1 | 0.968 | 24.4 | 1.5 | A | A |
| Example 2 | 6.3 | 27.8 | 3.8 | 0.968 | 24.6 | 1.5 | A | A |
| Example 3 | 6.4 | 27.4 | 5.1 | 0.967 | 24.6 | 1.5 | B | A |
| Example 4 | 6.4 | 27.6 | 5.5 | 0.965 | 23.9 | 1.5 | B | A |
| Example 5 | 6.4 | 27.3 | 3.9 | 0.967 | 24.2 | 1.5 | A | A |
| Example 6 | 6.4 | 27.4 | 4.2 | 0.965 | 23.8 | 1.5 | A | A |
| Example 7 | 6.5 | 27.6 | 5.8 | 0.966 | 24.3 | 1.5 | B | A |
| Example 8 | 6.7 | 26.2 | 8.8 | 0.966 | 24.8 | 1.5 | B | A |
| Example 9 | 6.9 | 25.8 | 10.5 | 0.964 | 23.3 | 1.5 | C | B |
| Example 10 | 7.2 | 24.9 | 12.1 | 0.962 | 23.4 | 1.5 | C | B |
| Example 11 | 7.3 | 24.8 | 14.2 | 0.960 | 23.1 | 1.5 | C | B |
| Comparative Example 1 | 9.1 | 22.9 | 23.2 | 0.959 | 21.8 | 1.5 | E | C |
| Comparative Example 2 | 8.5 | 23.1 | 23.6 | 0.960 | 21.9 | 1.5 | E | B |
| Comparative Example 3 | 7.9 | 24.1 | 16.8 | 0.967 | 25.4 | 12.0 | D | A |
| Reference Example 1 | 8.1 | 23.1 | 18.8 | 0.967 | 25.9 | 1.5 | D | A |

TABLE 4

| | Hot air temperature (° C.) | Circularity: Average circularity | Circularity: 0.990 or more (%) | Evaluation result 0.990 or more |
|---|---|---|---|---|
| Example 12 | 169 | 0.970 | 24.9 | A |
| Example 13 | 170 | 0.970 | 25.4 | B |
| Example 14 | 171 | 0.970 | 26.4 | B |
| Example 15 | 185 | 0.970 | 34.3 | C |
| Example 16 | 172 | 0.970 | 29.1 | B |
| Example 17 | 173 | 0.970 | 29.9 | B |
| Example 18 | 173 | 0.970 | 30.6 | C |
| Example 19 | 175 | 0.970 | 32.1 | C |
| Example 20 | 175 | 0.970 | 31.9 | C |
| Example 21 | 177 | 0.970 | 31.1 | C |
| Example 22 | 179 | 0.970 | 32.6 | C |
| Comparative Example 4 | 183 | 0.970 | 36.1 | D |
| Comparative Example 5 | 182 | 0.970 | 40.8 | E |
| Comparative Example 6 | 172 | 0.970 | 30.8 | C |

REFERENCE SIGNS LIST

1: raw material-quantitatively supplying unit; 2: compressed gas flow rate adjustment unit; 3: introducing tube; 4: protruding member; 5: supplying tube; 6: treating chamber; 7: hot air-supplying unit; 8: cold air-supplying unit; 9: columnar member; 10: recovering unit; 11: outlet of hot air-supplying unit; 12: hot air-distributing member; 13: turning member; 14: supplying port; 15: dispersion air-supplying port; 16: dispersion air-supplying member; 17: flow rate adjustment mechanism; 18: blade; and 19: branching tube While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-131145, filed Jun. 13, 2011, which is hereby incorporated by reference herein in its entirety.

The invention claimed is:

1. A heat treating apparatus for powder particles each of which contains a binder resin and a colorant, the heat treating apparatus comprising:

(1) a treating chamber in which a heat treatment of the powder particles is performed, (2) a raw material-supplying unit for supplying the powder particles to the treating chamber, (3) a hot air-supplying unit that supplies hot air for heat-treating the powder particles to the treating chamber, (4) a cold air-supplying unit that supplies cold air for cooling the heat-treated powder particles, and (5) a recovering unit that recovers the heat-treated powder particles, wherein the raw material-supplying unit comprises an introducing tube and a distributing member provided opposite to an outlet portion of the introducing tube, the distributing member is provided with a protruding member on a portion opposite to the outlet portion of the introducing tube, the distributing member comprises a supplying tube having two or more flow paths, the flow paths guiding a raw material in a direction from the protruding member toward a wall surface of the treating chamber, the supplying tube comprises a compressed air-injecting port or an external air-sucking port, and the compressed air-injecting port or the external air-sucking port is equipped with a flow rate adjustment mechaniam.

2. The heat treating apparatus for powder particles according to claim 1, wherein the supplying tube comprises four or more flow paths and the flow paths extend radially outwardly from the protruding member toward a wall surface of the treating chamber.

3. The heat treating apparatus for powder particles according to claim 1, wherein the raw material-supplying unit is equipped with a dispersion air-supplying member for dispersing toner particles to an upper portion of the introducing tube.

4. The heat treating apparatus for powder particles according to claim 1, which is equipped with a diffusing member inside of the introducing tube.

5. A method of producing a toner that obtains a toner through a step of heat-treating powder particles containing a binder resin and a colorant, wherein a heat treating apparatus according to claim 1 is used in the heat-treating step.

* * * * *